US006651346B1

(12) United States Patent
Sturgis et al.

(10) Patent No.: US 6,651,346 B1
(45) Date of Patent: Nov. 25, 2003

(54) HAND TOOL WITH INTERCHANGEABLE IMPLEMENTS

(75) Inventors: Kenneth Ashby Sturgis, Hampton, VA (US); David Gregory Miller, Seaford, VA (US); Joseph Wayne Kuchta, Hampton, VA (US)

(73) Assignee: Sturgis Tools, Inc., Hampton, VA (US)

( * ) Notice: Subject to any disclaimer, the term of this patent is extended or adjusted under 35 U.S.C. 154(b) by 0 days.

(21) Appl. No.: 10/010,172

(22) Filed: Nov. 13, 2001

(51) Int. Cl.[7] ..... B26B 5/00

(52) U.S. Cl. ..... 30/337; 30/339; 30/342

(58) Field of Search ..... 30/156–157, 236, 30/260, 261, 262, 308.3, 329, 337, 339, 335, 340–344, 351; 81/423; 606/167

(56) References Cited

U.S. PATENT DOCUMENTS

| | | | | | |
|---|---|---|---|---|---|
| 236,105 | A | * | 12/1880 | Stohlmann | 30/337 |
| 445,237 | A | * | 1/1891 | Yankauer | 30/339 |
| 960,624 | A | | 6/1910 | Compton | |
| 1,964,947 | A | * | 7/1934 | Hentschel | 30/171 |
| 2,049,898 | A | | 8/1936 | Driest | |
| 2,535,253 | A | | 12/1950 | Anderson | |
| 2,655,723 | A | * | 10/1953 | Steele | 30/339 |
| 3,088,148 | A | | 5/1963 | Moret | |
| 3,562,826 | A | | 2/1971 | Vaughn | |
| 3,900,950 | A | | 8/1975 | Collins | |
| 4,173,071 | A | * | 11/1979 | Ishida | 30/339 |
| 4,248,660 | A | | 2/1981 | Johnson | |
| 5,018,956 | A | | 5/1991 | LeMaster | |
| 5,337,442 | A | | 8/1994 | Stewart | |
| 5,440,811 | A | * | 8/1995 | Challis | 30/169 |
| 5,860,337 | A | | 1/1999 | Janssen | |
| 5,979,058 | A | | 11/1999 | Henke | |
| 5,996,448 | A | * | 12/1999 | Suekage | 81/177.2 |
| 6,035,536 | A | | 3/2000 | Dewberry | |
| 6,085,424 | A | | 7/2000 | Mai | |
| 6,131,290 | A | | 10/2000 | Chiou | |
| 6,138,735 | A | | 10/2000 | Field et al. | |
| 6,219,878 | B1 | | 4/2001 | Dewberry | |

FOREIGN PATENT DOCUMENTS

| | | | | |
|---|---|---|---|---|
| FR | A008003 | * | 10/1907 | 81/177.2 |

* cited by examiner

*Primary Examiner*—D. S. Meislin
(74) *Attorney, Agent, or Firm*—Willcox & Savage, P.C.; Kevin W. Grierson

(57) ABSTRACT

A hand tool having a handle provided with a mating surface for detachably securing the handle to a removable attachment. The mating surfaces of the handle and the removable attachment are exposed when not secured together. This feature facilitates cleaning of the device.

1 Claim, 11 Drawing Sheets

110
163
133

110
162
132

110
131
161

HAND TOOL WITH INTERCHANGEABLE IMPLEMENTS

FIELD OF THE INVENTION

The invention relates generally to handheld tools, and more particularly, to tools with interchangeable implements for carrying out a variety of tasks.

BACKGROUND OF THE INVENTION

Conventional hand tools are generally composed of a blade or other implement and a handle that is fastened fixedly to the implement and must be discarded when the implement becomes damaged or worn. In addition, such. tools require additional storage space because each implement requires its own handle. Most hand tools with detachable implements, however, are unsuited for household and contractor use because of the difficulty encountered in fastening the implement to the handle in a stable manner, and because of the difficulty cleaning the attachment surface where the implement and handle attach, since that surface is usually enclosed within the handle.

SUMMARY OF THE INVENTION

An objective of preferred embodiments of the present invention is to provide a hand tool with (1) a detachable implement that can be securely fastened to the handle, and (2) an attachment surface for detachable implements that is easily accessible for cleaning.

Another objective achieved by some embodiments of the present invention is to provide a hand tool with a handle that is detachably fastened to various implements, in which the angle of the implement to the handle of the tool can be changed by the attachment of extenders that are bent at predetermined angles to the longitudinal axis of the handle.

An additional objective of various embodiments of the present invention is to provide a hand tool that can accommodate detachable implements in which the attachment portion of the implement varies in thickness.

Yet another objective of selected embodiments of the present invention is to provide a hand tool with a handle that is detachably fastened with an implement so as to facilitate the storage and transportation of the hand tool.

The foregoing objectives are attained by a hand tool comprising a handle and at least one removable attachment. The handle comprises a grip, a first mating surface and a fastening mechanism for fastening the attachment detachably with the handle. In preferred embodiments, the attachment is provided at one end with a second mating surface comprised of a fastening slot. The preferred attachment is fastened securely by sliding the second mating surface of the attachment longitudinally along the first mating surface of the handle so that the fastening mechanism of the handle passes through the fastening slot, then pressing the attachment downward transversely to the handle until the second mating surface of the mates with the first mating surface of the attachment handle. The attachment is then secured by actuating the fastening mechanism.

Additional objects and advantages of embodiments of the invention will be set forth in part in the description which follows, and in part will be obvious from the description, or may be learned by practice of the invention. The objects and advantages of the invention will be obtained by means of instrumentalities in combinations particularly pointed out in the appended claims.

BRIEF DESCRIPTION OF THE DRAWINGS

The accompanying drawings illustrate a complete embodiment of the invention according to the best modes so far devised for the practical application of the principles thereof, and in which:

FIG. 3*b* shows an attachment with a cutting blade.

DETAILED DESCRIPTION OF A PREFERRED EMBODIMENT

Figure 1A:
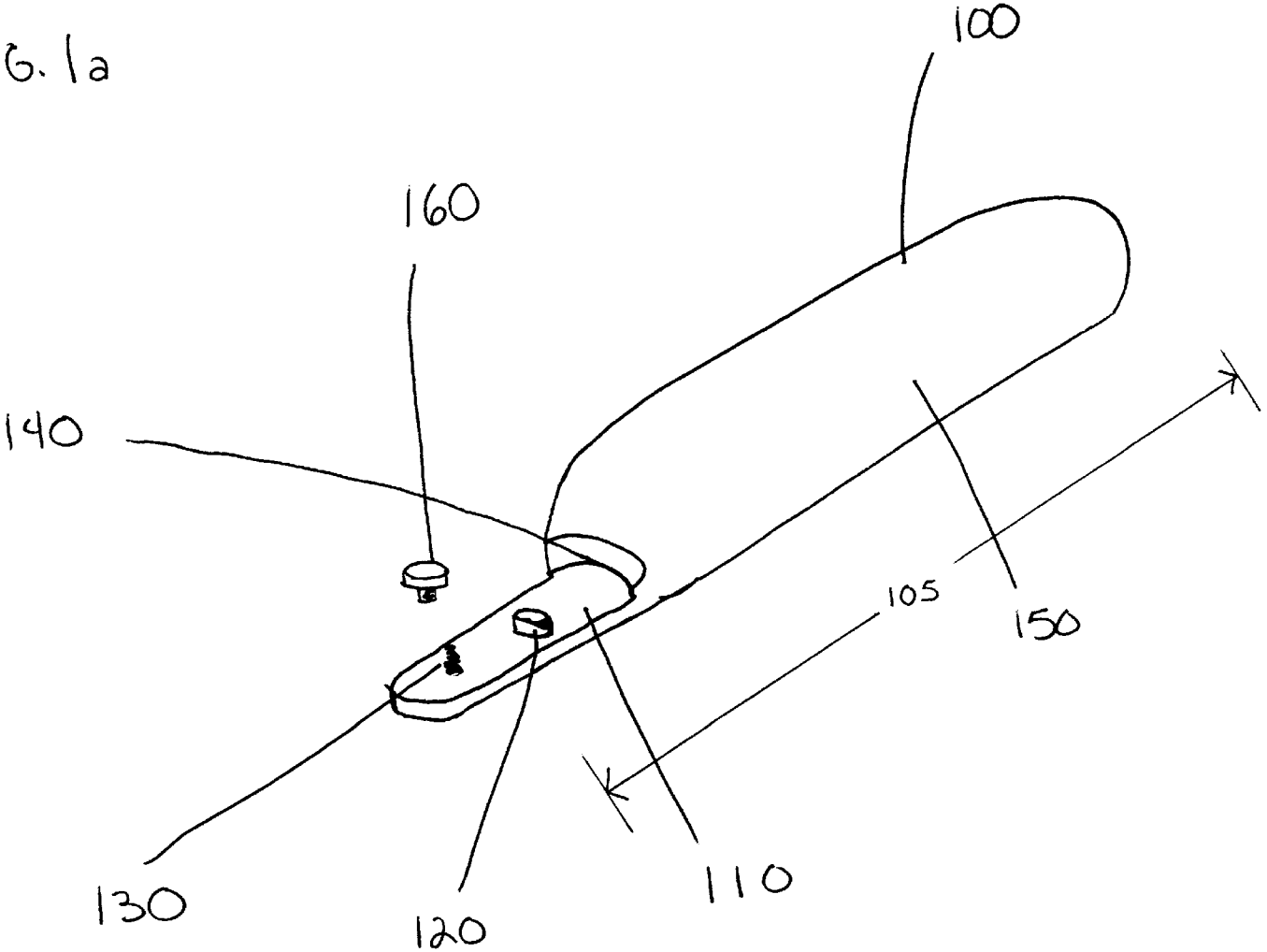
FIG. 1*a* shows a perspective view of the handle of the present invention.
Figures 1B, 1C, 1D:
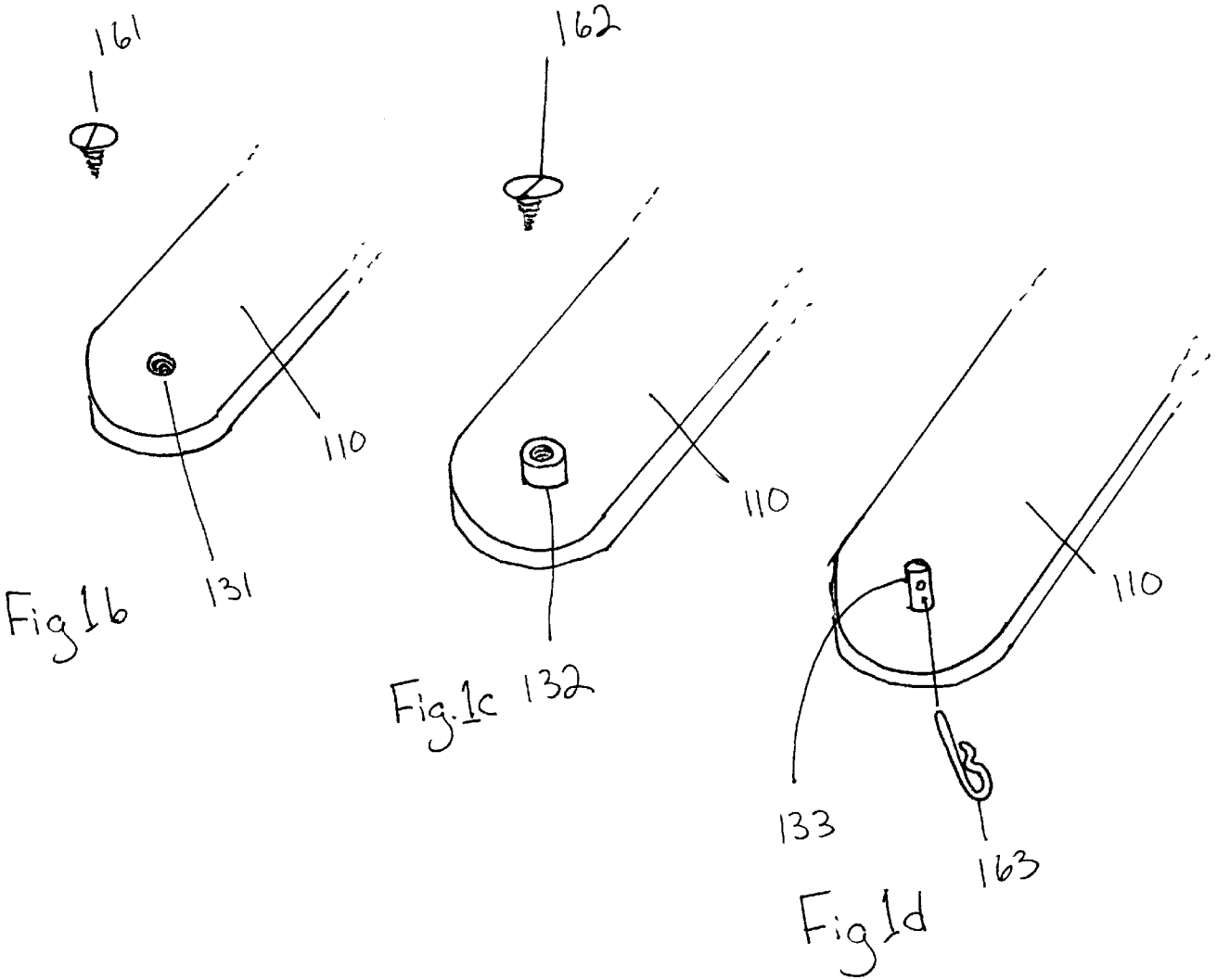
FIG. 1*b* shows an alternative fastening mechanism, namely, a screw and threaded hole.
FIG. 1*c* shows an alternative fastening mechanism, namely, a screw and threaded post.
FIG. 1*d* shows an alternative fastening mechanism, namely, a post and cotter pin.
Figure 2A:
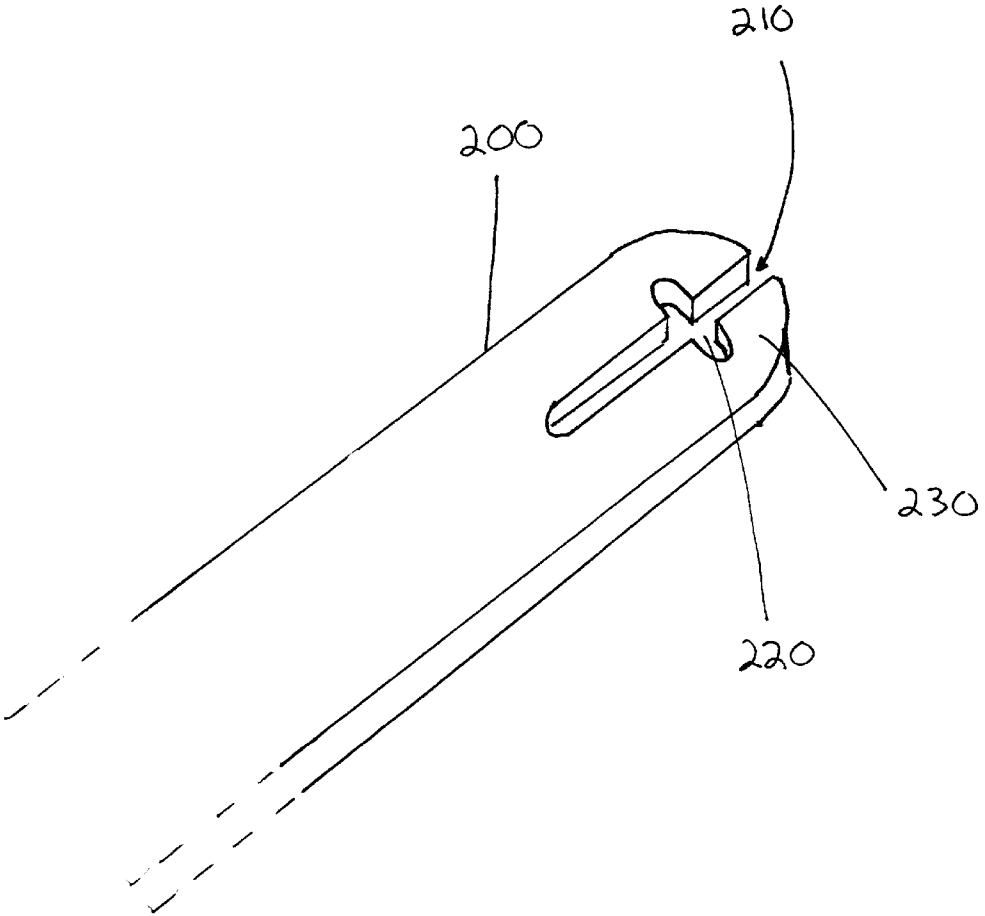
FIG. 2*a* shows the second mating surface of an attachment.
Figure 2B:
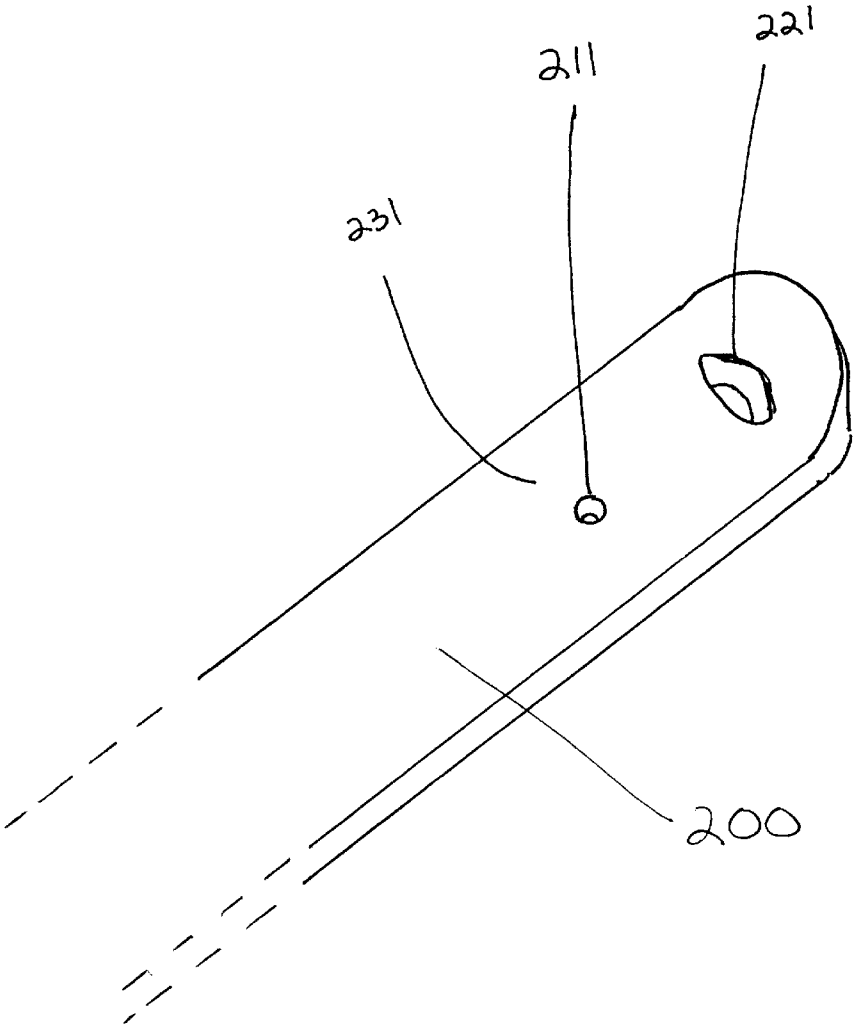
FIG. 2*b* shows an alternative second mating surface of the attachment.
Figure 2B:
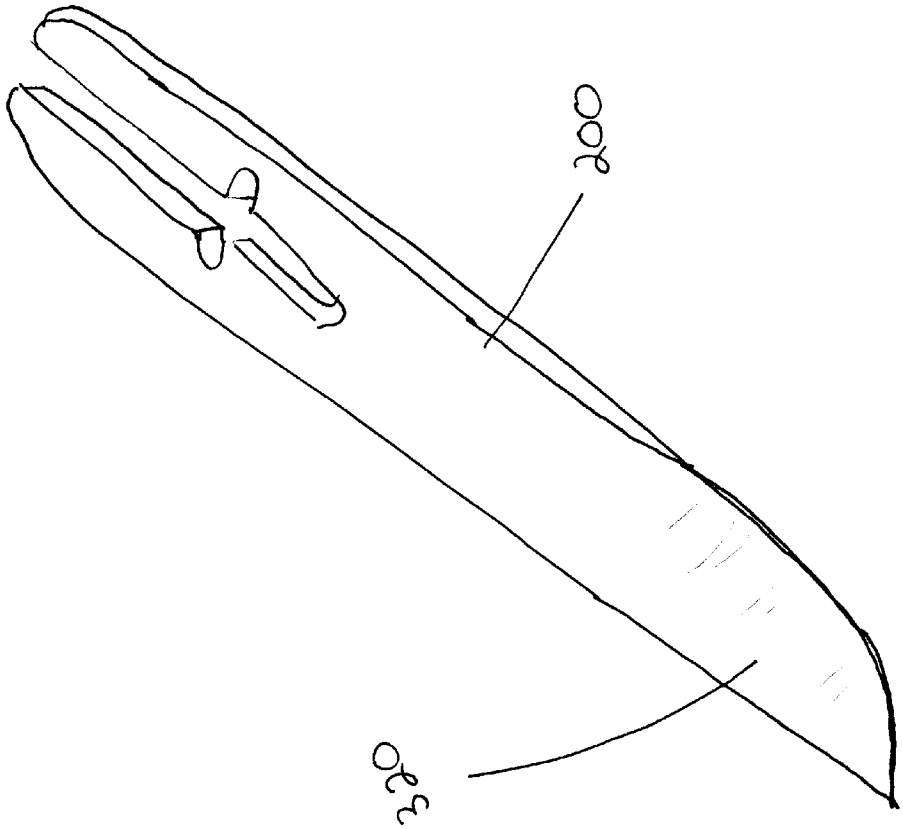

In a preferred embodiment, as shown in FIGS. 1–2, a hand tool as embodied in the present invention is comprised of a handle 100 having a first mating surface 110 (shown in FIG. 1*a*) and a removable attachment 200 having a second mating surface 230 (shown in FIG. 2*a*).

Referring to FIG. 1*a*, the handle 100 has a first end and a second end with a longitudinal axis 105 extending from the first end to the second end. A first mating surface 110 is located at the first end. The handle 100 includes a grip 150, located near the proximal portion of the first mating surface 110. In a preferred embodiment, a threaded post 130 on the first mating surface and thumb nut 160 are used as a fastening mechanism for securing the first mating surface 110 to the second mating surface of the removable attachment. Preferably the handle 100 also includes a stabilizing mechanism in the form of a locking post 120, and a stabilizing mechanism in the form of a recess 140 to further stabilize the removable attachment.

In FIG. 2*a* the removable attachment 200 comprises a second fastening surface 230 at one end. In some removable attachments 200, a functional element (shown and discussed later) is located at the end opposing the second fastening surface 230. In other removable attachments 200, the opposing end is used to make the removable attachment 200 into an extender, which will be shown and discussed in more detail later. In preferred embodiments, the second fastening surface 230 contains a slot 210 through which the fastening mechanism is passed, and an aperture 220 dimensioned to accommodate the locking post (shown as 120 in FIG. 1*a*).

The removable attachment 200 shown in FIG. 2*a* may be attached to the handle 100 shown in FIG. 1*a* by the following steps. The first step involves fitting the threaded post 130 of the handle 100 into the slot 210 of the removable attachment 200. The removable attachment 200 is then slid onto the handle. At least a portion of the sliding is done with the removable attachment 200 tilted so that the locking post 120 does not interfere with the second mating surface 230. Then the removable attachment 200 is untilted so that the locking post 120 engages the aperture 220 that is dimensioned to accommodate it. By tightening the nut 160 on the threaded post 130 the removable attachment 200 is secured to the handle 100. Note that the nut 160 need not be removed with these preferred embodiments that include a slot 210 in the second fastening surface 230. Other embodiments of the invention that do not include a slot 210 require removal of the nut 160.

FIG. 1*b* shows an alternative fastening mechanism comprised of a threaded hole 131 in the first mating surface 110 of the handle and a screw 161 that inserts into the hole 131. Similarly, FIG. 1*c* shows another alternative fastening mechanism comprised of a post 132 containing a threaded axial hole on the first mating surface 110 of the handle and a screw 162 that inserts into the threaded axial hole of the post 132. FIG. 1*d* shows another alternative fastening mechanism comprised of a post 133 on the first mating surface 110 of the handle with a diametrical hole, and a cotter pin 163 that passes through the diametrical hole of the post 133. Many additional fastening mechanisms can be used to secure the first mating surface to the second mating surface.

FIG. 2*b* shows an alternative second mating surface 231 for the removable attachment 200, which contains a hole 211 through which the fastening mechanism passes and a recess 221 dimensioned to accommodate a locking post (shown as 120 in FIG. 1*a*). In embodiments that utilize a second mating surface 231 that does not include a slot, the removable attachment 200 cannot be slid onto the handle. Instead, the first and second mating surfaces are placed together.

With reference to FIGS. 1*a–d* and 2*a–b*, note that both the first mating surface 110 and the second mating surface 230 are exposed when they are not secured to each other. The term "exposed" is used to mean that these surfaces are open for cleaning. A user of the device would have easy access to the exposed surfaces. Preferably, access to exposed surfaces is available from multiple directions, hence the side walls of a socket would not be considered exposed, because access is only available from one direction (the opening of the socket).

Figure 3A:
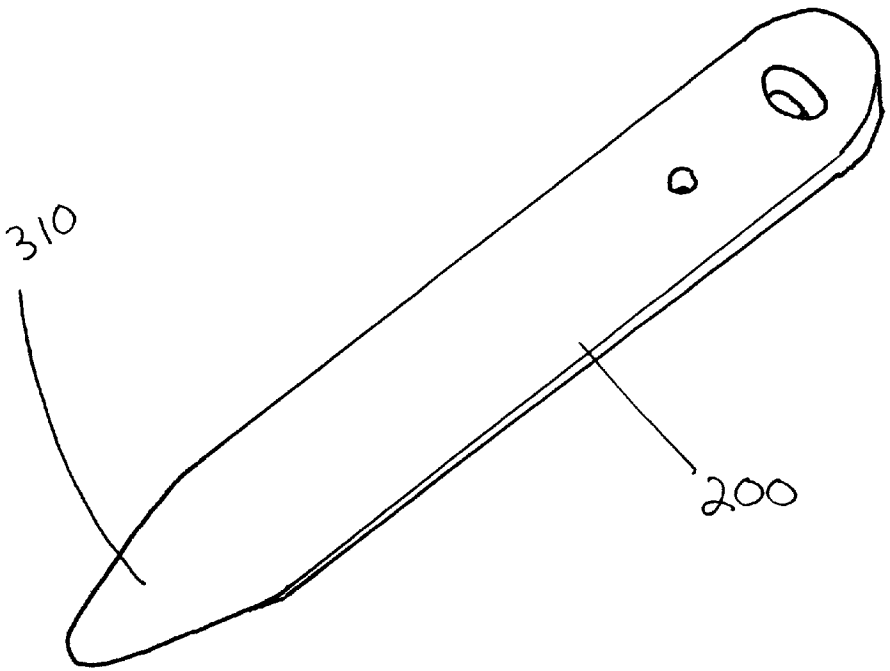
FIG. 3*a* shows an attachment with a smoothing blade.

FIGS. 3*a* and 3*b* show removable attachments 200 that include a functional portion at the end opposing the second mating surface 230. FIG. 3*a* shows a removable attachment 200 in which the functional portion is a smoothing blade 310, as is used in caulking applications. FIG. 3*b* shows a removable attachment 200 with a sharp-edged blade 320.

Figure 4A:
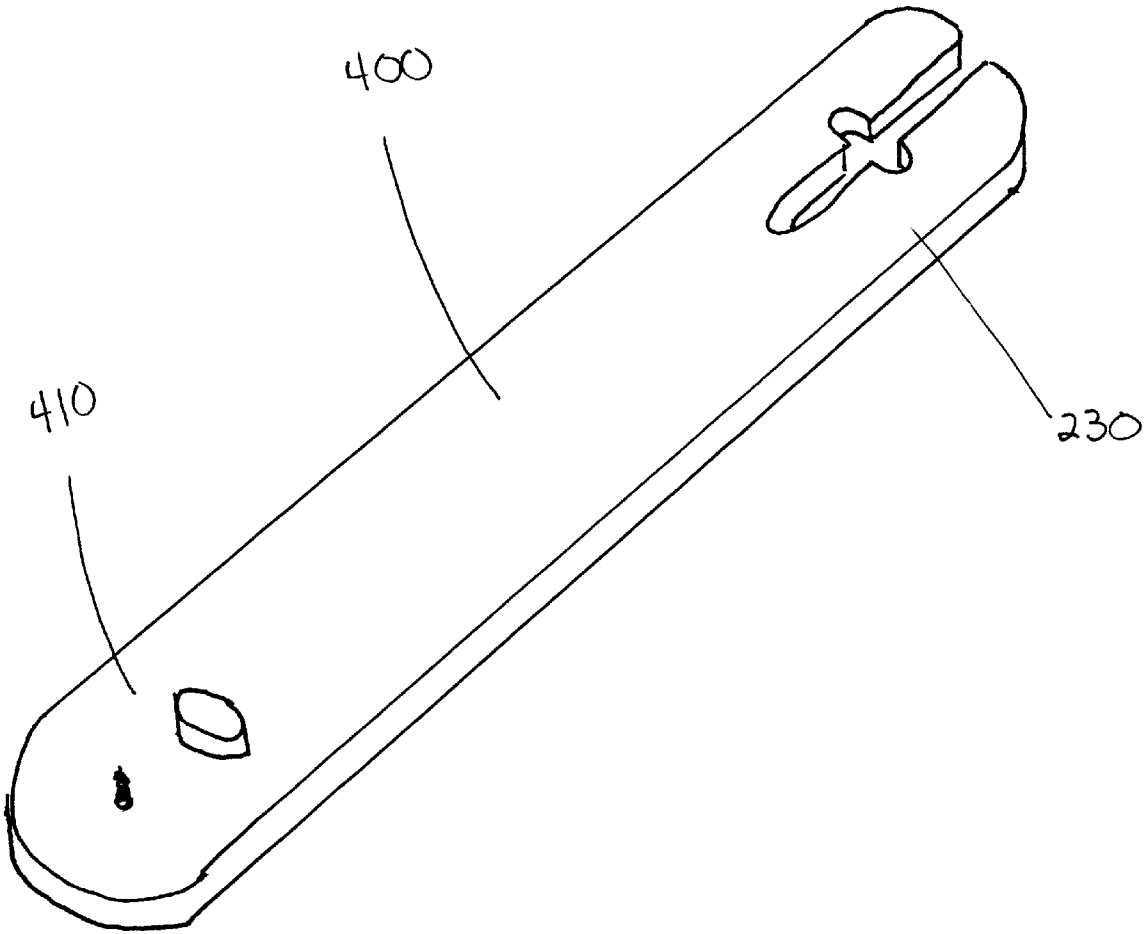
FIG. 4*a* shows an extender attachment with a third mating surface.
Figure 4B:
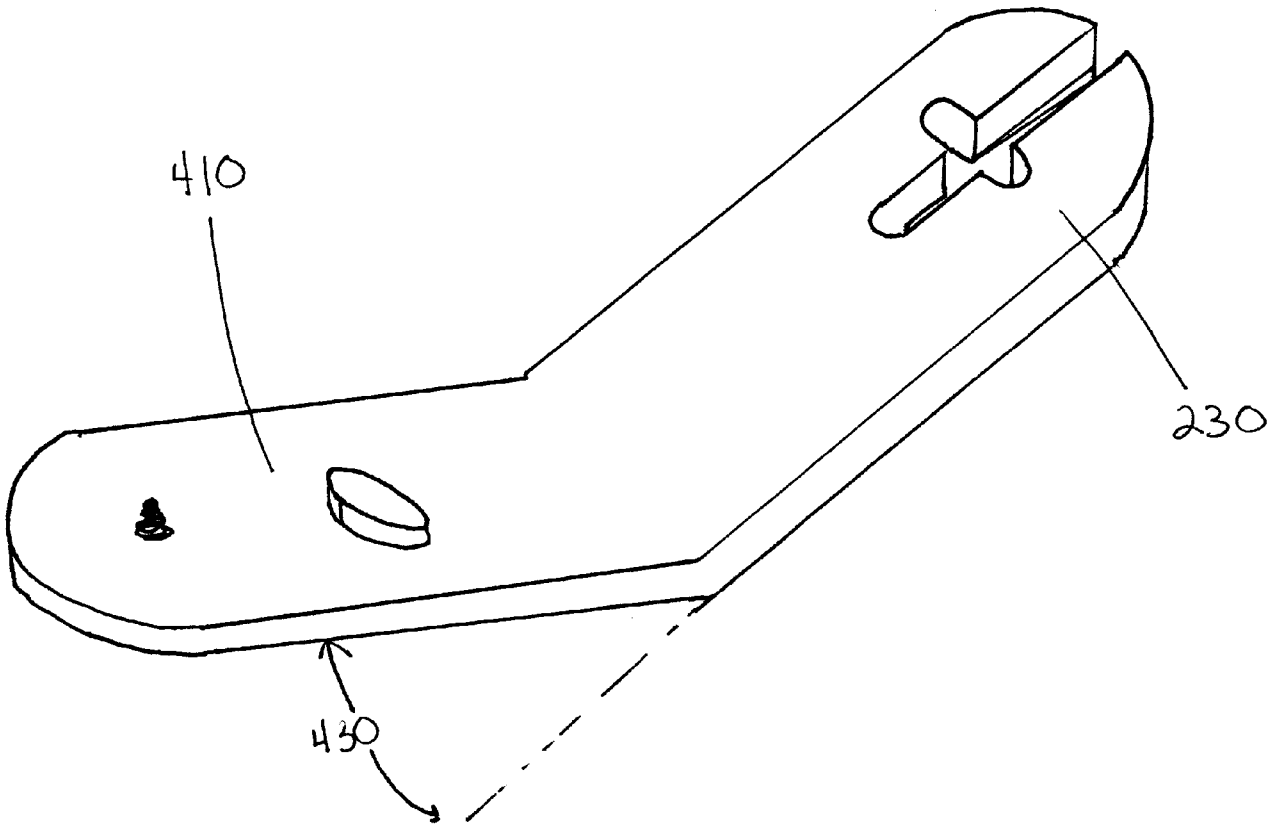
FIG. 4*b* shows an extender in which the third mating surface is inclined at an angle to the second mating surface.

In FIGS. 4*a* and 4*b* the removable attachments are shown as extenders 400, that are designed to support a second removable attachment at the end opposing the second mating surface 230. FIG. 4*a* shows a first removable attachment in the form of an extender 400, with a third mating surface 410 that mates with the fourth mating surface of a second removable attachment. The second mating surface 230 and the third mating surface 410 of the extender 400 may be approximately coplanar as shown in FIG. 4*a*, or, as in FIG. 4*b*, the third mating surface 410 may be inclined at a nonzero angle 430 relative to the second mating surface 230 of the extender 400. The most preferred angle for an extender is approximately 24 degrees. However, various embodiments include extenders with a variety of angles extending from 0 to 90 degrees.

In preferred embodiments the third mating surface 410 of the extender 400 matches the first mating surface of the handle. In such embodiments, the fourth mating surface of a second removable attachment matches the second mating surface of a first removable attachment and removable attachments may be secured to either the handle or an extender, depending upon the requirements of the task.

Figure 5:
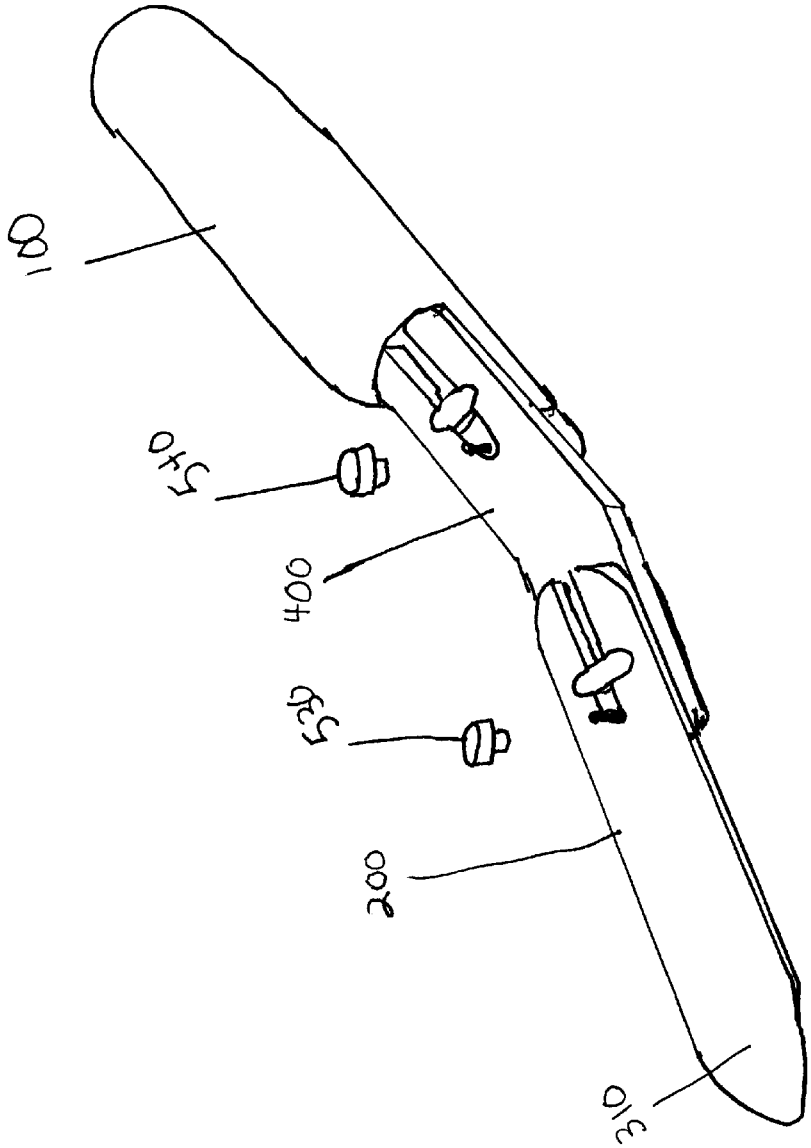
FIG. 5 shows a hand tool with an attached extender and smoothing blade.

FIG. 5 shows a handle 100 coupled to an extender 400 that is angled. In this embodiment, the extender 400, is the first removable attachment and a second removable attachment 200 with a smoothing blade 310 is coupled to the extender 400. When the nuts 530, 540 are screwed onto their respective threaded posts, the extender 400 will be secured to the handle 100 and the second removable attachment 200 with the smoothing blade 310 will be secured to the extender 400. Notice how the end of the second mating surface fits into the recess in the handle, thereby helping to stabilize the removable attachments. Note that the nuts are removed for illustrative purposes only and need not be completely removed in order to secure the removable attachments.

Figure 6:
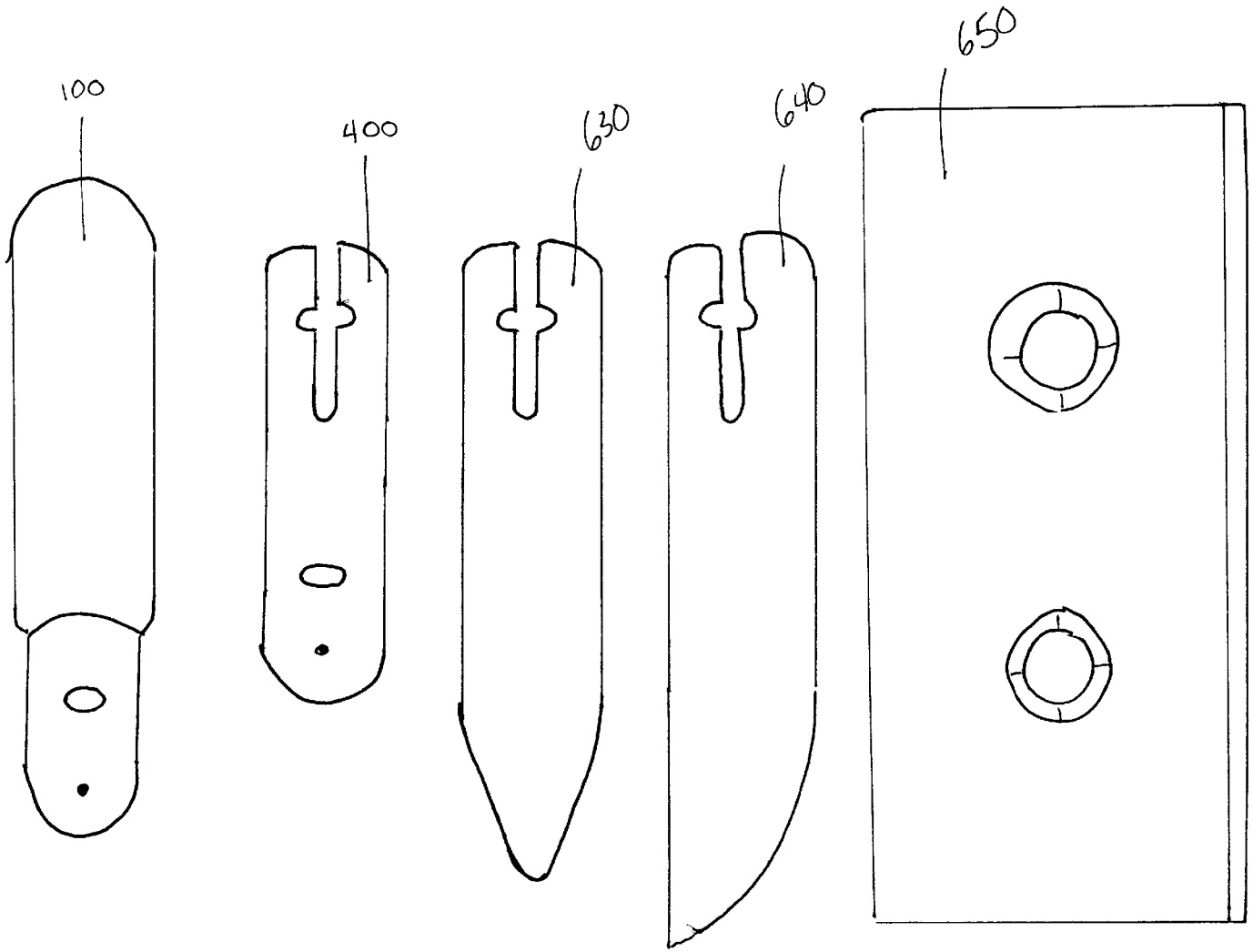
FIG. 6 shows a hand tool kit with instructional video.

FIG. 6 shows a kit containing a handle 100, an extender 400, a removable attachment with a cutting blade 630, a removable attachment with a smoothing blade 640, and an instructional video 650. The instructional video explains the assembly and use of the various items in the kit.

Figure 7:
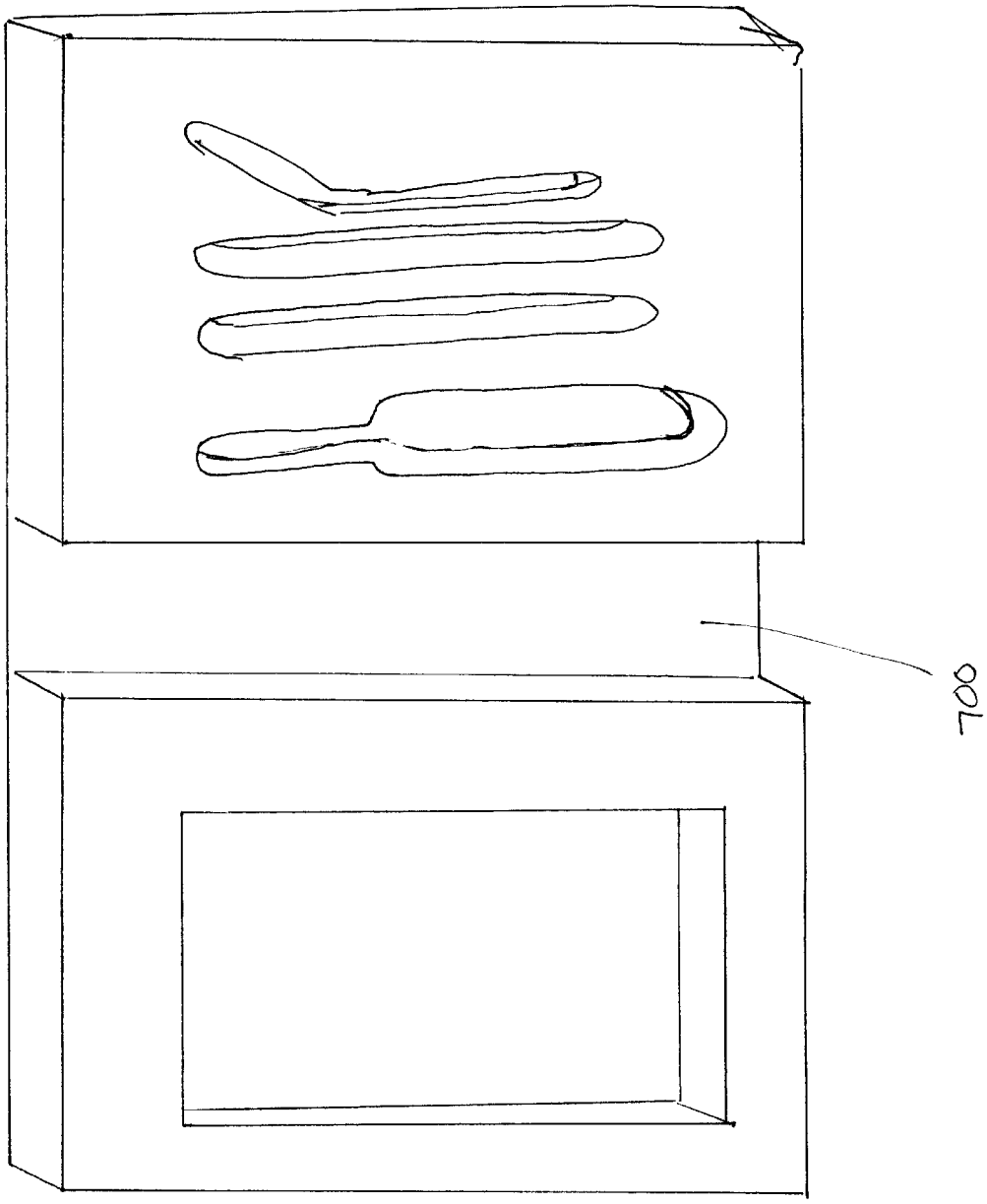
FIG. 7 shows a carrying case with recesses for the handle, attachments, and instructional video.

FIG. 7 is a perspective view of a carrying case with recesses for a handle, an extender, a removable attachment with a smoothing blade, a removable attachment with a cutting blade, and an instructional video.

The above description and drawings are only illustrative of preferred embodiments which achieve the objects, features and advantages of the present invention, and it is not intended that the present invention be limited thereto. Any modification of the present invention that comes within the spirit and scope of the following claims is considered part of the present invention.

What is claimed is:

1. A method for exchanging an old removable attachment on a handle for a new removable attachment, wherein the handle has a grip and a first mating surface with a threaded post extending from the first mating surface, a nut attached to the threaded post, and a locking post extending from the first mating surface, the locking post having an elongated cross section; and both new and old removable attachments each having a second mating surface with a slot and a locking-post hole for receiving the locking post, the method comprising:

loosening the nut attached to the threaded post;

tilting the old removable attachment, thereby disengaging the locking post from the locking-post hole;

sliding the old removable attachment off of the handle;

choosing a new removable attachment;

fitting the threaded post of the handle into the slot of the new removable attachment;

sliding the new removable attachment onto the handle, at least a portion of this sliding step being done with the new removable attachment being tilted so that the locking post does not interfere with the second mating surface;

untilting the new removable attachment engaging the locking post in the locking-post hole; and tightening the nut attached to the threaded post.

* * * * *